US006388507B1

(12) United States Patent
Hwang et al.

(10) Patent No.: US 6,388,507 B1
(45) Date of Patent: May 14, 2002

(54) VOLTAGE TO CURRENT CONVERTER WITH VARIATION-FREE MOS RESISTOR

(75) Inventors: Chanku Hwang, Palo Alto; Hassan Osama Elwan, Santa Clara, both of CA (US)

(73) Assignee: Hitachi America, Ltd., Tarrytown, NY (US)

( * ) Notice: Subject to any disclaimer, the term of this patent is extended or adjusted under 35 U.S.C. 154(b) by 0 days.

(21) Appl. No.: 09/758,520

(22) Filed: Jan. 10, 2001

(51) Int. Cl.[7] ..... G05F 1/10
(52) U.S. Cl. ..... 327/538
(58) Field of Search ..... 323/312, 315, 323/316; 327/530, 534, 538, 543

(56) References Cited

U.S. PATENT DOCUMENTS 5,349,286 A * 9/1994 Marshall et al. ..... 323/315
6,107,868 A * 8/2000 Diniz et al. ..... 327/543
6,201,436 B1 * 3/2001 Hur et al. ..... 327/543

* cited by examiner

*Primary Examiner*—Jeffrey Zweizig
(74) *Attorney, Agent, or Firm*—Townsend and Townsend and Crew LLP; Chad R. Walsh

(57) ABSTRACT

A voltage controlled current source circuit of the present invention includes first reference current coupled to a voltage control node. A current input of a voltage controlled impedance is reproduced at the voltage control node through a current mirror as a second reference current. The voltage resulting from the action of the first and second reference currents is coupled to a voltage control input of the voltage controlled impedance. In one embodiment, a control voltage is provided to the gate of a transistor. The source of the transistor is coupled to the current input of a second voltage controlled impedance circuit to produce an output current at the drain of the transistor. The second voltage controlled impedance circuit has a voltage control input coupled to the voltage control input of the first voltage controlled impedance and to the voltage control node.

26 Claims, 3 Drawing Sheets

VOLTAGE TO CURRENT CONVERTER WITH VARIATION-FREE MOS RESISTOR

BACKGROUND OF THE INVENTION

The present invention relates to current source circuits and, more particularly, to a voltage controlled current source circuit.

FIG. 1 illustrates a conventional voltage controlled current source circuit 100 for generating a current in response to a voltage. Such circuits are also known in the art as voltage-to-current converters. The voltage controlled current source circuit 100 of FIG. 1 includes a transistor 101 and a load impedance 102. The transistor 101 of voltage controlled current source circuit 100 receives a control voltage $V_{in}$ and produces an output current $I_0$. The transistor 101 may be an NMOS transistor, for example. The current at the output is given by the equation:

$$I_o = \frac{(V_{in} - V_{th})}{R},$$

where $I_0$ is the output current, $V_{in}$ is the control voltage, $V_{th}$ is the threshold voltage of the NMOS transistor, and R is the resistance of the load impedance.

Another conventional voltage controlled current source circuit 200 is shown in FIG. 2. The voltage controlled current source circuit 200 of FIG. 2 includes a transistor 201 and an active load impedance 202. The load impedance used in voltage controlled current source 200 is a NMOS transistor bias in the triode region of operation. The transistor 201 of voltage controlled current source circuit 200 receives a control voltage $V_{in}$ and produces an output current $I_0$. The transistor 201 may be an NMOS transistor, for example.

One major problem with voltage controlled current sources, such as those in FIGS. 1 and 2 is that the load impedance is typically implemented using integrated circuit technology. For example, the resistor in FIG. 1 may be implemented using doped polysilicon, for example. However, typical polysilicon resistors can achieve a tolerance on only about 20% across process. Additionally, process and temperature variations may cause deviations in the circuits of FIGS. 1 and 2 by as much as 60%. Accordingly, voltage controlled current sources utilizing integrated circuit resistors can suffer deviations in the voltage to current relations that are unacceptable in many applications.

Accordingly, a voltage controlled current source that reduces the variation in the voltage to current relationship across process and temperature variations is desired.

SUMMARY OF THE INVENTION

A voltage controlled current source circuit, in accordance with one embodiment of the present invention, includes a first precision reference current coupled to a voltage control node, a first voltage controlled impedance circuit having a current input and a first voltage control input, and a first current mirror having a first current terminal coupled to the current input of the first voltage controlled impedance and a second current terminal, wherein the first current mirror generates a second reference current on the second current terminal. The first precision reference current and the second reference current are coupled together at the voltage control node. Additionally, the first voltage control input is coupled to the voltage control node.

A voltage controlled current source circuit, in accordance with another embodiment of the present invention, includes a first resistor, a first current mirror having a current terminal coupled to a first terminal of the first resistor, wherein the first current mirror generates a first reference current, a first voltage controlled impedance circuit having a current input and a first voltage control input, a second current mirror having a current terminal coupled to the current input of the voltage controlled impedance, wherein the second current mirror generates a second reference current. The first reference current and the second reference current are coupled together at a voltage control node and the first voltage control input is coupled to the voltage control node.

A voltage controlled current source circuit, in accordance with another embodiment of the present invention, includes a first transistor having a control terminal coupled to a control voltage, a first terminal, and a second terminal, a first resistor, a first current mirror having a current terminal coupled to a first terminal of the first resistor, wherein the first current mirror generates a first reference current, a first voltage controlled impedance circuit having a current input and a first voltage control input, a second current mirror having a current terminal coupled to the current input of the voltage controlled impedance, and a second voltage controlled impedance circuit having a current input coupled to the second terminal of the first transistor, and a second voltage control input, wherein the second current mirror generates a second reference current. The first reference current and the second reference current are coupled together at a voltage control node and the first voltage control input is coupled to the voltage control node.

According to one embodiment, the first resistor is an external resistor for generating a reference current.

According to one embodiment, the present invention includes a method of controlling a current. The method comprises generating a first current through a resistor, generating a second current at a current input of a voltage controlled impedance, providing reproductions of the first current and the second current at a voltage control node to generate a first control voltage at the voltage control node, and coupling the first control voltage at the voltage control node to a voltage input of the voltage controlled impedance, wherein the first control voltage corresponds to the difference between the first current and the second current.

The following detailed description and the accompanying drawings provide a better understanding of the nature and advantages of the present invention.

DESCRIPTION OF THE SPECIFIC EMBODIMENTS

Figure 1:
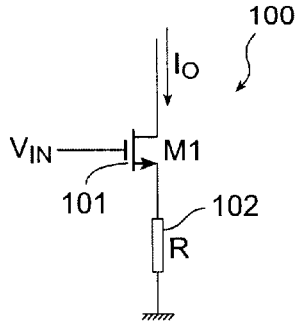
FIG. 1 (PRIOR ART)
FIG. 1 illustrates a contemporary voltage controlled current source circuit for generating a current in response to a voltage.
Figure 2:
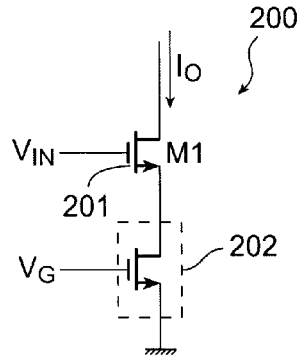
FIG. 2 (PRIOR ART)
FIG. 2 illustrates another contemporary voltage controlled current source circuit for generating a current in response to a voltage.
Figure 3:
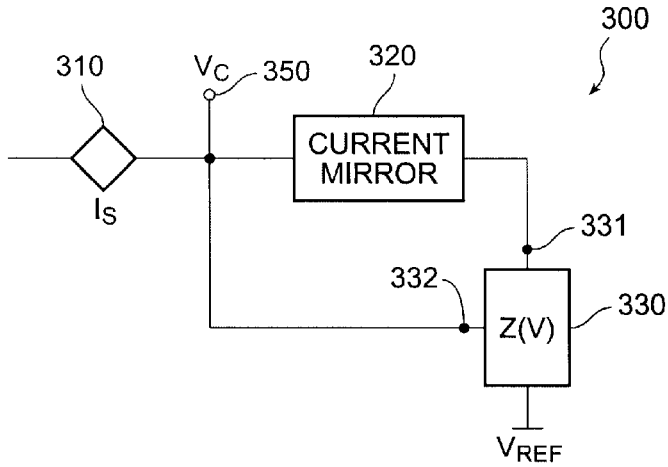
FIG. 3 illustrates a voltage controlled current source circuit according to one embodiment of the present invention.

FIG. 3 illustrates a voltage controlled current source circuit according to one embodiment of the present invention. Voltage controlled current source circuit 300 includes a precision reference current source 310, a first current mirror 320, and a voltage controlled impedance 330. The precision reference current source 310 generates a reference current that is coupled to a voltage control node $V_c$ 350. The voltage controlled impedance circuit is coupled between a current input 331 and a reference voltage $V_{ref}$, and includes a voltage control input 332 for varying the impedance characteristic between the current input and $V_{ref}$. Accordingly, the impedance of the voltage controlled impedance circuit is dependent upon the voltage at the voltage control input 332. Furthermore, the first current mirror 320 has a first current terminal coupled to current input 331 of the voltage controlled impedance. A second current terminal of the current mirror 320 is coupled to the voltage control node.

In operation, the precision reference current source generates a precision current into or out of voltage control node 350. Additionally, the voltage controlled impedance circuit sets up a current between the current input 331 and the reference voltage $V_{ref}$. The current mirror 320 provides a reproduction of the current in the voltage controlled impedance circuit. The reproduced current is a second reference current that is driven out of or into the voltage control node 350. The action of the precision reference current and the second reference current from the current mirror 320 act to increase or decrease the voltage at the voltage control node 350. The voltage on the voltage control node 350, in turn, acts to alter the impedance of the voltage controlled impedance circuit 330 such that the current through the voltage controlled impedance circuit 330 is the same as the precision reference current.

Figure 4:
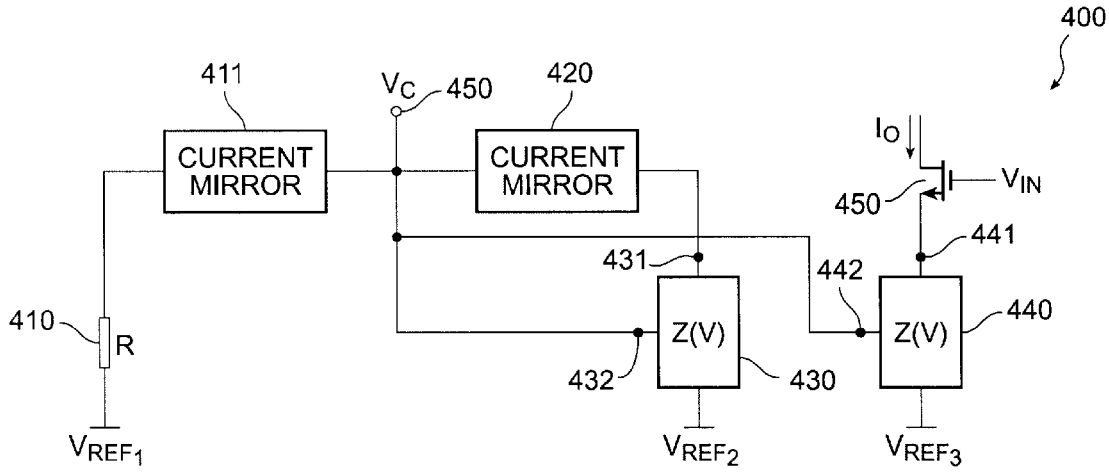
FIG. 4 illustrates a voltage controlled current source circuit according to another embodiment of the present invention.

FIG. 4 illustrates voltage controlled current source circuit 400 according to another embodiment of the present invention. Voltage controlled current source circuit 400 includes a resistor 410 having a terminal coupled to a first voltage reference $V_{ref1}$. The resistor may be a high tolerance resistor such as an external 0.01% resistor, for example. The other terminal of resistor 410 is coupled to a current terminal of current mirror 411. The current mirror 411 has a second current terminal coupled to voltage control node 450 for generating a precision reference current into or out of voltage control node 450. Voltage controlled current source circuit 400 also includes a first voltage controlled impedance circuit 430. The first voltage controlled impedance circuit 430 is coupled between a current input 431 and a second voltage reference $V_{ref2}$. The current input 431 is coupled to a current mirror 420. A first current terminal of the current mirror 420 is coupled to the voltage control node 450 and a second terminal of the current mirror 420 is coupled to the current input of the voltage controlled impedance circuit 430. The voltage control node 450 is coupled to a voltage control input 432 of the first voltage controlled impedance circuit 430.

Additionally, the voltage control node 450 is coupled to a voltage control input 442 of a second voltage controlled impedance circuit 440. The second voltage controlled impedance circuit 440 is coupled between a current input 441 and a third a voltage reference $V_{ref3}$. The current input of the second voltage controlled impedance circuit 440 is coupled to the source of an NMOS transistor 450. The gate of the NMOS transistor 450 is coupled to receive a control voltage $V_{in}$, and the drain provides a voltage controlled output current $I_0$. By providing a precision reference current into voltage control node 450, and by adjusting the voltage on voltage control node 450 to ensure that the current through the first voltage controlled impedance circuit 430 matches the precision reference current, the voltage controlled impedance circuits 430 and 440 can thereby be tuned to provide precise voltage to current relationships across process and temperature variations. It is to be understood that in various embodiments of the present invention, the polarity of the precision reference current, the second reference current of the current mirror 420, and the control voltage to impedance relation of the voltage controlled impedance circuits may be altered according to known principles to achieve the features and advantages of the present invention. Such modifications would be within the knowledge of one of ordinary skill in the art in light of the present disclosure. Accordingly, in one embodiment $V_{ref1}$, $V_{ref2}$, and $V_{ref3}$ may be at the same potential (e.g. ground potential or zero volts), or alternatively at different potentials from one or more of each other.

Figure 5:
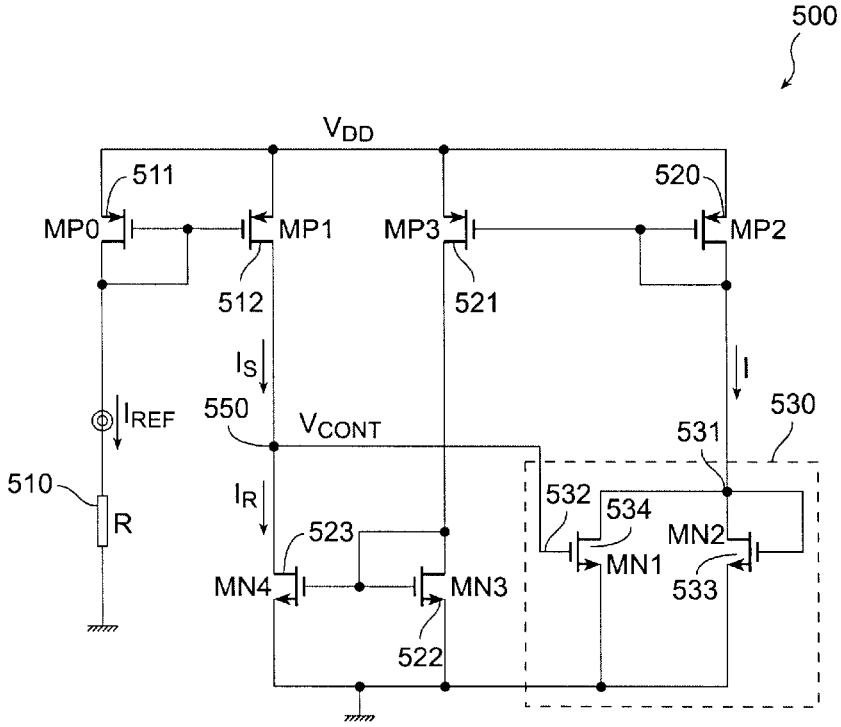
FIG. 5 illustrates an exemplary implementation of a voltage controlled current source circuit according to one embodiment of the present invention.

FIG. 5 illustrates an exemplary implementation of a voltage controlled current source circuit 500 according to one embodiment of the present invention. Voltage controlled current source circuit 500 includes a resistor 510 coupled between the drain of a PMOS transistor 511 and ground. PMOS transistor 511 has a source coupled to a supply voltage Vdd and a gate coupled to the drain. The gate of PMOS transistor is also coupled to the gate of PMOS transistor 512. The source of PMOS transistor 512 is also coupled to Vdd, and the drain is coupled to a voltage control node 550. Together, PMOS transistor 511, PMOS transistor 512, and resistor 510 form a precision current source for providing a precision reference current Is into voltage control node 550. Additionally, transistors 511 and 512 form a single stage current mirror as is well known in the art.

Voltage control node 550 is coupled to a voltage control input 532 of an exemplary voltage controlled impedance circuit 530. Voltage controlled impedance circuit 530 includes a first NMOS transistor 534 having a gate coupled to the voltage control node 550. The drain of transistor 534 is coupled to the current input 531 of the voltage controlled impedance circuit 530. The source of transistor 534 is coupled to ground. Voltage controlled impedance circuit 530 also includes a second NMOS transistor 533 having a gate and drain coupled to the current input 531 and a source coupled to ground. The voltage to current relationship of the voltage controlled impedance circuit 530 can be obtained by observing the following:

$$I = \frac{V}{R_{eq}}, \tag{1}$$

$$I_{MN1} = k_1(V_{gs1} - V_{t1})V_{ds1} - \frac{k_1 V_{ds1}^2}{2}, \tag{2}$$

$$I_{MN2} = \frac{k_2}{2}(V_{gs2} - V_{t2})^2. \tag{3}$$

Additionally, the following relations apply:

$$I = I_{MN1} + I_{MN2}, \tag{4}$$

$$V_{ds1} = V_{ds2}, \tag{5}$$

$$V_{ds1} = V_{gs1} + V_{t1}. \tag{6}$$

Therefore, assuming matched devices (i.e. $k_1 = k_2 = k$), the voltage to current relation is given by:

$$I = k(V_{gs1} - V_{t1})V_{ds2}. \tag{7}$$

This corresponds to an equivalent resistance for the voltage controlled impedance circuit given by:

$$R_{eq} = \frac{1}{k(V_c - V_{t1})}, \quad (8)$$

where $V_c$ is the voltage at the voltage control node 530, $V_{t1}$ is the threshold voltage of NMOS transistor 534, and k is a device parameter.

The current I into the current input 531 of voltage controlled impedance circuit 530 is passed through a two-stage current mirror comprised of transistors 520, 521, 522, and 523 to produce a reference current $I_R$. The reference current $I_R$ and precision reference current $I_s$ act to increase or decrease the voltage at the voltage control node 550. The voltage on voltage control node 550, in turn, acts to alter the impedance of the voltage controlled impedance circuit 530 such that the current through the voltage controlled impedance circuit 530 is the same as the precision reference current $I_s$.

Figure 6:
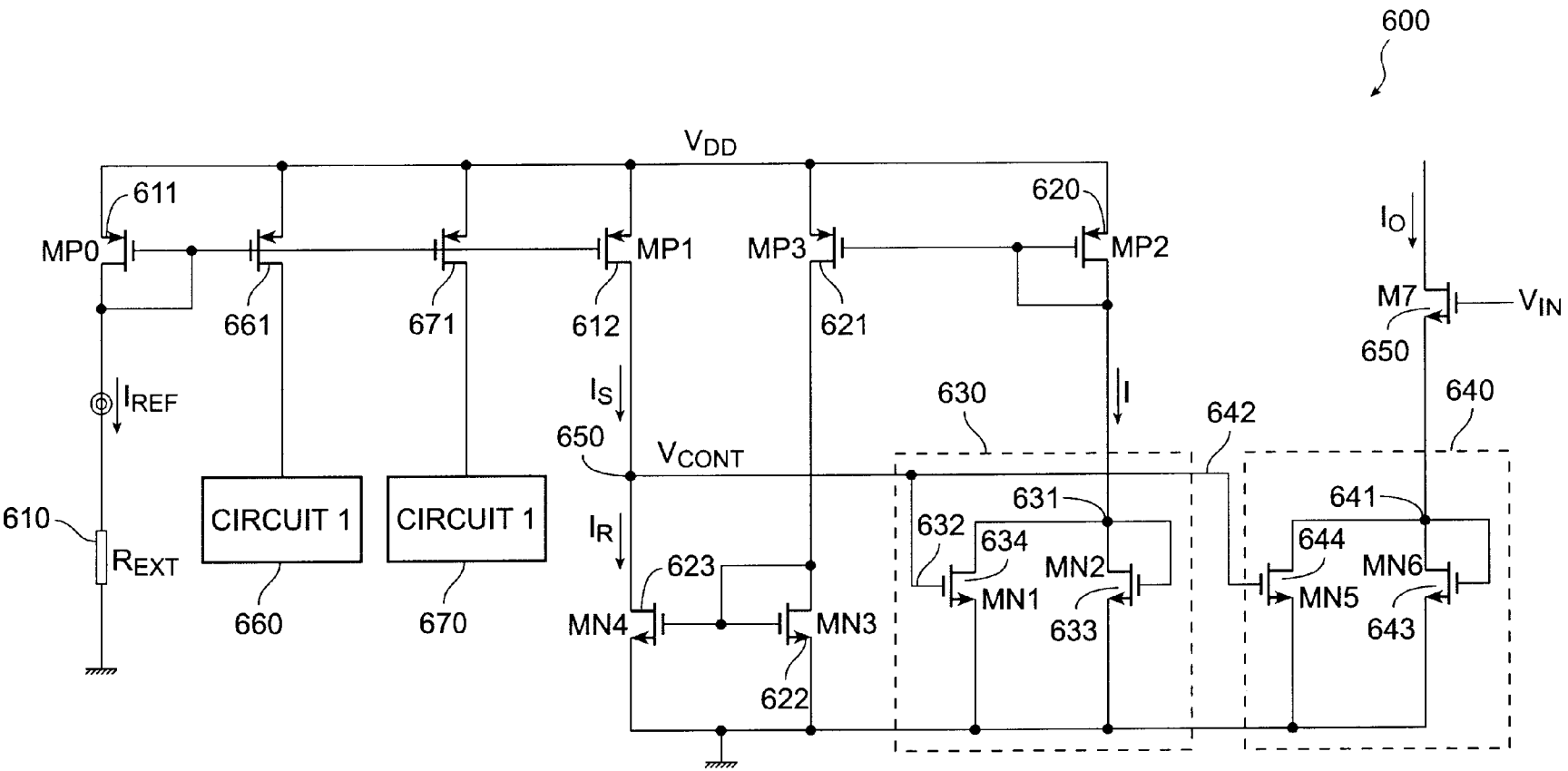
FIG. 6 illustrates another exemplary implementation of a voltage controlled current source circuit according to another embodiment of the present invention.

FIG. 6 illustrates another exemplary implementation of a voltage controlled current source circuit 600 according to one embodiment of the present invention. Voltage controlled current source circuit 600 includes a resistor 610 coupled between the drain of a PMOS transistor 611 and ground. In one embodiment, resistor 610 is an external resistor having a high tolerance. It is to be understood that the tolerance of a resistor is a term to refer to the precision of the resistor. Therefore, a 1 kΩ (i.e. kilo-ohm) resistor having a high tolerance of 0.01%, for example, will have an actual resistor value of 1 kΩ±10Ω. A first terminal of the resistor 610 is coupled to a reference voltage (e.g. ground). A second terminal of the resistor 610 is coupled to the drain and gate of a PMOS transistor 611. PMOS transistor 611 has a source coupled to a supply voltage Vdd. Accordingly, a very accurate current $I_{ref}$ may be set up in resistor 610.

The gate of PMOS transistor 611 is also coupled to the gate of PMOS transistor 612. The source of PMOS transistor 612 is coupled to Vdd, and the drain is coupled to a voltage control node 650. Together, PMOS transistor 611 and PMOS transistor 612 form a current mirror to mirror current $I_{ref}$. A precision current $I_s$ appears at the current output terminal of the current mirror comprised of transistors 611 and 612. It is to be understood that the combination of PMOS transistor 611, PMOS transistor 612, and resistor 610 form a precision current source for providing a precision reference current $I_s$ into voltage control node 650. Accordingly, other forms of process and temperature insensitive precision current sources could also be used. In one embodiment, the W/L (i.e. width to length of the gate) ratio of PMOS transistor 611 to PMOS transistor 612 is M:N. Therefore, according to well known principles, the precision reference current $I_s$ can be scaled.

Voltage control node 650 is coupled to voltage control inputs 632 and 642 of exemplary voltage controlled impedance circuits 630 and 640. Voltage control node 650 is also coupled to a current input 631 of voltage controlled impedance circuit 630 through a two-stage current mirror. A current mirror comprised of PMOS transistor 620 and PMOS transistor 621 includes a first current terminal coupled to the current input 631 of voltage controlled impedance circuit 630. The source of PMOS transistor 620 is coupled to a supply voltage Vdd. The gate and drain of PMOS transistor 620 are coupled together to form the first current terminal of the current mirror. The gate of PMOS transistor 620 is also coupled to the gate of PMOS transistor 621. The source of PMOS transistor 621 is coupled to the supply voltage Vdd, and the drain of PMOS transistor 621 forms the second current terminal of the current mirror.

A current mirror comprised of NMOS transistor 622 and NMOS transistor 623 includes a first current terminal coupled to the drain of PMOS transistor 621. The source of NMOS transistor 622 is coupled to ground. The gate and drain of NMOS transistor 622 are coupled together to form the first current terminal of the current mirror. The gate of NMOS transistor 622 is also coupled to the gate of NMOS transistor 623. The source of NMOS transistor 623 is coupled to the ground. The drain of NMOS transistor 623 forms the second current terminal of the current mirror, and is coupled to the voltage control node 650.

The voltage controlled impedance 630 has a current input 631 coupled to the voltage control node 650 through the two-stage current mirror and a voltage control input coupled to receive a voltage from the voltage control node. The voltage controlled impedance includes a first NMOS transistor 634 having a gate coupled to the voltage control node 650. The drain of transistor 634 is coupled to the current input 631 of the voltage controlled impedance circuit 630. The source of transistor 634 is coupled to ground. Voltage controlled impedance circuit 630 also includes a second NMOS transistor 633 having a gate and drain coupled to the current input 631 and a source coupled to ground.

The voltage controlled impedance 630 will generate a current I. This current will be reproduced at the voltage control node 630 by the action of the two-stage current mirror comprised of PMOS transistors 620 and 621 and NMOS transistors 622 and 623. Additionally, resistor 610 will generate a current $I_{ref}$. $I_{ref}$ will be reproduced at the voltage control node 630 by the action of the current mirror comprised of PMOS transistors 611 and 612. As a result, two reference currents will act to change the voltage on the voltage control node 650, and the voltage on the voltage control node 650 is used to adjust the current I to be equal to the current through the resistor. For example, if I is greater than $I_{ref}$, then $I_R$ is greater than $I_s$, and the voltage on the voltage control node 650 will decrease. However, as the voltage at node 650 decreases, the gate voltage on NMOS transistor decreases and the current I begins to decrease. On the other hand, if $I_{ref}$ is greater than I, then $I_s$ is greater than $I_R$, and the voltage on the voltage control node 650 will increase. However, as the voltage at node 650 increases, the gate voltage on NMOS transistor increases and the current I begins to increase. As a result, the impedance of the voltage controlled impedance 630 will be determined by the value of the reference current $I_s$. For the voltage controlled current source circuit 600, the reference current is set by resistor 610, and the impedance of the voltage controlled impedance 630 will be equal to the resistance of resistor 610.

In one embodiment, one or more of transistors pairs 611 and 612, 620 and 621, and/or 622 and 623 may have scaled W/L ratios to change the relation between the reference current $I_s$ and the impedance of the voltage controlled impedance 630. For example, if transistors 611 and 612 are scaled 1:2 respectively, then $I_s$ is twice the value $I_{ref}$. Therefore, I will be twice the value of $I_{ref}$ and the impedance of the voltage controlled impedance circuit 630 will be one-half the value of resistor 610. On the other hand, if transistors 620 and 621, or transistors 622 and 623, are scaled 1:2 respectively, then $I_R$ is twice the value I. Therefore, I will be one-half the value of $I_{ref}$ and the impedance of the voltage controlled impedance circuit 630 will be twice the value of resistor 610. Of course, other scaling combinations could be used to adjust the impedance of the voltage controlled impedance circuit 630 in light of the above description.

The voltage at the voltage control node 650 of voltage controlled current source 600 can also be used to establish currents in other portions of an electronic system. For example, voltage controlled current source 600 also includes a second voltage controlled impedance circuit 640. As illustrated in equation (8) above, the equivalent resistance $R_{eq}$ of voltage controlled impedance circuits 630 and 640 of the present embodiment are independent of the voltage at the current inputs 631 and 641, and dependent upon the voltage at the voltage control inputs 632 and 642. Therefore, reference current $I_s$ can be set to establish the requisite voltage on node 650 for the desired equivalent resistance for the voltage controlled impedance 630, and the voltage on node 650 can be used to control the equivalent resistance of other voltage controlled impedance circuits (e.g. circuit 640) in other portions of the circuit.

For example, voltage controlled impedance circuit 640 includes an NMOS transistor 644 having a gate coupled to the voltage control node 650 for controlling the equivalent resistance between the current input 641 and ground. NMOS transistor has a drain coupled to the current input 641 and a source coupled to ground. A second NMOS transistor 643 has a source coupled to the source of NMOS transistor 644. The gate and drain of NMOS transistor 644 are coupled to the drain of NMOS transistor 643. NMOS transistor 650 has a source coupled to the current input 641 of the voltage controlled impedance 640 and a drain coupled to some other portion of the system. The gate of NMOS transistor 650 receives a control voltage Vin for controlling the current Io at the drain. For the present embodiment, the equivalent resistance of the voltage controlled impedance 640 is equal to the resistance of resistor 610 (i.e. Rext). Therefore, the current Io at the drain of transistor 650 is given as follows:

$$I_o = \frac{V_{in} - V_t}{E_{ext}}. \tag{9}$$

Having fully described alternative embodiments of the present invention, other equivalent or alternative techniques according to the present invention will be apparent to those skilled in the art. For example, while the present invention was primarily described in connection with a PMOS current mirrors and NMOS voltage controlled impedance circuits, opposite polarity devices could also be used. These equivalents and alternatives along with the understood obvious changes and modifications are intended to be included within the scope of the present invention as defined by the following claims.

What is claimed is:

1. A voltage controlled current source circuit comprising:

a first transistor having a control terminal coupled to a control voltage, a first terminal, and a second terminal;

a first resistor;

a first current mirror having a current terminal coupled to a first terminal of the first resistor, wherein the first current mirror generates a first reference current;

a first voltage controlled impedance circuit having a current input and a first voltage control input;

a second current mirror having a current terminal coupled to the current input of the voltage controlled impedance, wherein the second current mirror generates a second reference current; and a second voltage controlled impedance circuit having a current input coupled to the second terminal of the first transistor, and a second voltage control input;

wherein the first reference current and the second reference current are coupled together at a voltage control node, and wherein the first and second voltage control inputs are coupled to the voltage control node.

2. The voltage controlled current source circuit of claim 1 wherein the first transistor is an NMOS transistor, the first terminal is a drain terminal, and the second terminal is a source terminal.

3. The voltage controlled current source circuit of claim 1 wherein the first resistor is an external resistor.

4. The voltage controlled current source circuit of claim 3 wherein the external resistor is a high tolerance resistor.

5. The voltage controlled current source circuit of claim 1 further comprising a third current mirror having a first current terminal coupled to receive the second reference current and a second current terminal coupled to the voltage control node.

6. The voltage controlled current source circuit of claim 1 wherein the first voltage controlled impedance comprises:

a second transistor having a control terminal coupled to the voltage control node, a first terminal coupled to the current terminal of the second current mirror, and a second terminal; and a third transistor having a control terminal, a first terminal, and a second terminal, wherein the control terminal and first terminal of the third transistor are coupled to the current terminal of the second current mirror, and the second terminal of the third transistor is coupled to the second terminal of the second transistor.

7. The voltage controlled current source circuit of claim 1 wherein the second voltage controlled impedance comprises:

a second transistor having a control terminal coupled to the voltage control node, a first terminal coupled to the second terminal of the first transistor, and a second terminal; and a third transistor having a control terminal, a first terminal, and a second terminal, wherein the control terminal and first terminal of the third transistor are coupled to the second terminal of the first transistor, and the second terminal of the third transistor is coupled to the second terminal of the second transistor.

8. The voltage controlled current source circuit of claim 1 wherein first current mirror has a current ratio of M:N.

9. A voltage controlled current source circuit comprising:

a first resistor;

a first current mirror having a current terminal coupled to a first terminal of the first resistor, wherein the first current mirror generates a first reference current;

a first voltage controlled impedance circuit having a current input and a first voltage control input; and a second current mirror having a current terminal coupled to the current input of the voltage controlled impedance, wherein the second current mirror generates a second reference current;

wherein the first reference current and the second reference current are coupled together at a voltage control node, and wherein the first voltage control input is coupled to the voltage control node.

10. The voltage controlled current source circuit of claim 9 wherein the first reference current is directed into the voltage controlled node and the second reference current is directed out of the voltage controlled node.

11. The voltage controlled current source circuit of claim 9 wherein the first reference current is directed out of the voltage controlled node and the second reference current is directed into of the voltage controlled node.

12. The voltage controlled current source circuit of claim 9 wherein the first resistor is an external resistor.

13. The voltage controlled current source circuit of claim 9 further comprising a third current mirror having a first current terminal coupled to receive the second reference current and a second current terminal coupled to the voltage control node.

14. The voltage controlled current source circuit of claim 9 wherein the first voltage controlled impedance comprises:

a second transistor having a control terminal coupled to the voltage control node, a first terminal coupled to the current terminal of the second current mirror, and a second terminal; and a third transistor having a control terminal, a first terminal, and a second terminal, wherein the control terminal and first terminal of the third transistor are coupled to the current terminal of the second current mirror, and the second terminal of the third transistor is coupled to the second terminal of the second transistor.

15. A voltage controlled current source circuit comprising:

a first precision reference current coupled to a voltage control node;

a first voltage controlled impedance circuit having a current input and a first voltage control input; and a first current mirror having a first current terminal coupled to the current input of the first voltage controlled impedance, and a second current terminal, wherein the first current mirror generates a second reference current on the second current termninal;

wherein the first precision reference current and the second reference current are coupled together at the voltage control node, and wherein the first voltage control input is coupled to the voltage control node.

16. The voltage controlled current source circuit of claim 15 further comprising a second current mirror and a resistor to generate the first precision reference current.

17. The voltage controlled current source circuit of claim 15 further comprising a third current mirror to couple the second reference current to the voltage control node.

18. A voltage controlled current source circuit comprising:

a first PMOS transistor coupled between a supply voltage and a first node, the first PMOS transistor including a control terminal coupled to the first node;

a first resistor coupled between the first node and a reference voltage;

a second PMOS transistor coupled between the supply voltage and a voltage control node, the second PMOS transistor including a control terminal coupled to the control terminal of the first PMOS transistor;

a first NMOS transistor having a control terminal coupled to the voltage control node, a drain coupled to a second node, and a source;

a second NMOS transistor having a control terminal, a drain, and a source, wherein the control terminal and drain are coupled to the second node, and the source of the first NMOS transistor is coupled to the source of the second NMOS transistor;

a third PMOS transistor coupled between the supply voltage and the second node, the third PMOS transistor including a control terminal coupled to the second node;

a fourth PMOS transistor having a control terminal coupled to the control terminal of the first PMOS transistor, a source coupled to the supply voltage, and a drain; and a current mirror having a first current terminal coupled to the drain of the fourth PMOS transistor and a second current terminal coupled to the voltage control node.

19. The voltage controlled current source circuit of claim 18 wherein the first resistor is an external high tolerance resistor.

20. The voltage controlled current source circuit of claim 18 wherein the reference voltage is ground.

21. The voltage controlled current source circuit of claim 18 wherein the source of the first NMOS transistor and the source of the second NMOS transistor are coupled to the reference voltage.

22. The voltage controlled current source circuit of claim 18 further comprising:

a third NMOS transistor having a control terminal coupled to a control voltage, a drain, and a source;

a fourth NMOS transistor having a control terminal coupled to the voltage control node, a drain coupled to the source of the third NMOS transistor, and a source; and a fifth NMOS transistor having a control terminal, a drain, and a source, wherein the control terminal and drain are coupled to the source of the third transistor, and the source of the fourth NMOS transistor is coupled to the source of the fifth NMOS transistor.

23. A method of controlling a current comprising:

generating a first current through a resistor;

generating a second current at a current input of a voltage controlled impedance;

providing reproductions of the first current and the second current at a voltage control node to generate a first control voltage at the voltage control node; and coupling the first control voltage at the voltage control node to a voltage input of the voltage controlled impedance, wherein the first control voltage corresponds to the difference between the first current and the second current.

24. The method of claim 23 wherein providing reproductions of the first current and the second current comprises:

reproducing the first current in a first current mirror to produce a first reference current; and reproducing the second current in a second current mirror to produce a second reference current.

25. The method of claim 24 wherein the first reference current and the second reference current are of opposite polarity.

26. The method of claim 23 further comprising:

receiving a control voltage at the control terminal of a transistor, the transistor having a first terminal and a second terminal; and coupling the first control voltage at the voltage control node to a voltage input of a second voltage controlled impedance, wherein a current input of the second voltage controlled impedance is coupled to the second terminal of the transistor.

* * * * *